US010870995B1

(12) United States Patent
Meeks

(10) Patent No.: US 10,870,995 B1
(45) Date of Patent: Dec. 22, 2020

(54) LOWER EDGE FINISH FOR DRYWALL

(71) Applicants: Robert B. Jordan, IV, Mt. Gilead, NC (US); Eddie Alexander Meeks, Greensboro, NC (US)

(72) Inventor: Eddie Alexander Meeks, Greensboro, NC (US)

(73) Assignees: Robert B. Jordan, IV, Mt. Gilead, NC (US); Eddie Alexander Meeks, Greensboro, NC (US)

( * ) Notice: Subject to any disclaimer, the term of this patent is extended or adjusted under 35 U.S.C. 154(b) by 0 days.

(21) Appl. No.: 16/597,280

(22) Filed: Oct. 9, 2019

Related U.S. Application Data

(60) Provisional application No. 62/760,070, filed on Nov. 13, 2018.

(51) Int. Cl.
*E04F 19/06* (2006.01)
*E04F 19/04* (2006.01)
*E04B 2/78* (2006.01)

(52) U.S. Cl.
CPC ..... *E04F 19/061* (2013.01); *E04B 2/789* (2013.01); *E04F 19/049* (2013.01)

(58) Field of Classification Search
CPC ... E04F 19/061; E04F 19/049; E04F 19/0495; F16M 13/00; E04B 2/7457; E04B 2/285; E04B 2/82; E04B 2/789; E04B 2/74
See application file for complete search history.

(56) References Cited

U.S. PATENT DOCUMENTS 2,029,549 A * 2/1936 Winterich ..... E04F 13/12 52/288.1
2,946,099 A * 7/1960 Lawlor ..... E04F 13/06 52/718.02
4,622,791 A * 11/1986 Cook ..... E04B 2/825 52/241
D324,575 S * 3/1992 Davis ..... D25/119
5,970,671 A * 10/1999 Bifano ..... E04B 1/765 428/603
6,119,429 A * 9/2000 Bifano ..... E04B 1/765 52/101
6,293,064 B1 * 9/2001 Larson ..... E04B 1/762 52/209
6,298,609 B1 * 10/2001 Bifano ..... E04B 1/765 52/101
6,470,638 B1 * 10/2002 Larson ..... E04B 1/765 52/254
8,955,277 B1 * 2/2015 Joye ..... F16M 11/00 52/241
9,663,944 B1 * 5/2017 Lam ..... E04B 2/02
2005/0183361 A1 8/2005 Frezza ..... 52/293.3
2006/0107607 A1 * 5/2006 Dillon ..... E04F 19/04 52/211

(Continued)

*Primary Examiner* — Jessie T Fonseca
(74) *Attorney, Agent, or Firm* — MacCord Mason PLLC

(57) ABSTRACT

A wall assembly and a lower edge finish for a drywall. The wall assembly comprises a stud wall forming a support frame, a lower edge finish installed on the bottom of the stud wall, and a drywall sheet having a lower edge in the channel with its weight supported by the base secured to the stud wall. The lower edge finish has a channel formed from a first sidewall and a second sidewall receiving a drywall sheet, and a base underneath the channel supports the drywall sheet above a surface. The second sidewall and the base are surface mounted on the stud wall.

17 Claims, 2 Drawing Sheets

(56) References Cited

U.S. PATENT DOCUMENTS

| | | | | |
|---|---|---|---|---|
| 2010/0325969 | A1* | 12/2010 | Hourihan | A47K 3/008 52/35 |
| 2012/0255249 | A1* | 10/2012 | Singh | E04F 19/061 52/302.1 |
| 2013/0126694 | A1* | 5/2013 | Kline | E04F 19/061 248/346.5 |
| 2015/0308125 | A1* | 10/2015 | Helms | E04F 13/0866 52/309.9 |
| 2016/0208484 | A1* | 7/2016 | Pilz | E04B 2/7457 |
| 2016/0262576 | A1* | 9/2016 | Kratzmann | E04F 19/061 |
| 2016/0362898 | A1* | 12/2016 | Silk | E04F 19/049 |
| 2017/0306618 | A1* | 10/2017 | Braun | E04F 19/064 |
| 2017/0328057 | A1* | 11/2017 | Pilz | E04B 1/946 |
| 2018/0051470 | A1* | 2/2018 | Smith | E04F 13/045 |
| 2018/0171646 | A1* | 6/2018 | Stahl | E04F 21/0053 |

* cited by examiner

LOWER EDGE FINISH FOR DRYWALL

BACKGROUND OF THE INVENTION

Framed walls are typically comprised of a stud, post or column for structural support and a surface mounted onto the structural support. Plaster and stucco are examples of higher end materials used as surfaces to create a finished wall. However, drywall sheets are commonly used instead due to their lower cost. One caveat to installing drywall sheets is that the drywall sheet must remain raised over the floor surface to prevent it from absorbing moisture and forming mold.

Typically, drywall sheets are installed using drywall lifts to keep the drywall sheets above ground until they are fastened onto a structural support. Since that method of installation of drywall sheets leaves a gap between the bottom edge of the sheet and the floor, baseboards are commonly installed to conceal the spacing, which further adds to installation costs. When using metal framing, another option for installing a drywall sheet may comprise installing a stud wall onto a sill plate that extends under the studs and contains a shelf for supporting a drywall sheet, as disclosed in US Publication No. 2005/0183361. However, in that structure the plates must be installed before adding the studs.

Accordingly, there remains a need for a lower edge finish to support a drywall sheet that can be used even after the installation of a stud wall, while at the same time, concealing the gap between the drywall and floor without the need for installing a separate baseboard.

SUMMARY OF THE INVENTION

The present invention fulfills one or more of these needs in the art by providing a lower edge finish to support a drywall above a surface to prevent the drywall from molding while remaining easy to install and use. In a preferred embodiment, the lower edge finish for a drywall comprises a channel formed from a first sidewall and a second sidewall for receiving a drywall sheet, and a base underneath the channel for supporting the drywall sheet above a surface. The second sidewall and the base are adapted to be placed flush against a stud wall and the lower edge finish is free of extension from the second sidewall toward the stud wall.

The base may be continuous along a length of the channel. The height of the base may determine the height at which the drywall may be raised above a surface (typically the floor or subfloor). For example, the base may have a height of about ½ inches. In one embodiment, the base does not extend toward the stud wall past the second sidewall. For example, the base may be flush with the first sidewall and second sidewall.

The second sidewall may be taller than the first sidewall. The first sidewall may be spaced a distance apart from the second sidewall such that the first sidewall is almost flush with an outermost face of a drywall sheet when it is inserted into the channel.

In one embodiment, the base may be comprised of extruded plastic. For instance, the first sidewall and the second sidewall may be comprised of sheet metal. In a particular embodiment, the first sidewall is perforated. In another embodiment, the base and sidewalls are comprised of extruded plastic.

The invention may also be considered as a wall assembly including a stud wall forming a support frame, a lower edge finish installed on the bottom of a face of the stud wall, and a drywall sheet. The lower edge finish is mounted along a floor on which the stud wall rests, completely surface mounted on the stud wall. The lower edge finish comprises a channel formed from a first sidewall and a second sidewall that are spaced apart to enable receipt of the drywall sheet, and a base underneath the channel for supporting the drywall sheet above the floor. The drywall sheet has a lower edge in the channel with its weight supported by the base of the lower edge finish secured to the stud wall. The second sidewall and the base are placed flush against the stud wall. The wall assembly may further include a plate installed on the bottom of the stud wall. The base does not extend toward the stud wall past the second sidewall.

The present invention can also be considered a method for installing drywall. In one embodiment, the method comprises installing a stud wall on a floor, fastening a channel formed from a first sidewall and a second sidewall to the stud wall with the channel having a base so a bottom of the channel is spaced above the floor, and inserting a drywall sheet within the channel. The method may also further include a step of painting the drywall sheet and first sidewall to create a uniform appearance. Tape and/or drywall mud may be applied to the top edge of the first sidewall to smooth its appearance.

The step of installing a stud wall may comprise installing the studs of the stud wall onto a plate. The step of fastening the channel to the stud wall may comprise positioning the second sidewall to abut the stud wall and fastening the second sidewall to the stud wall.

BRIEF DESCRIPTION OF THE DRAWINGS

The invention will be better understood by a reading of the Detailed Description of the Examples of the Invention along with a review of the drawings, in which.

DETAILED DESCRIPTION OF EXAMPLES OF THE INVENTION

Figure 1:
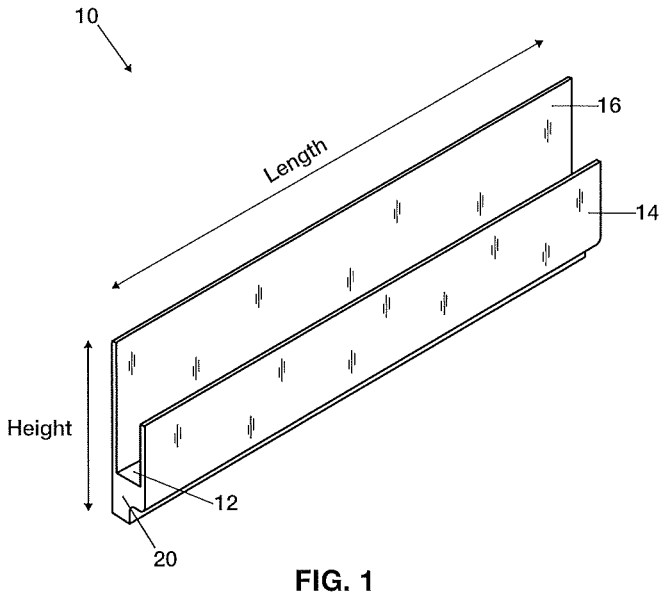
FIG. 1 is an overhead perspective view of a lower edge finish for a drywall constructed according to one embodiment.

FIG. 1 shows a lower edge finish 10 for a drywall made in accordance with features of the current invention. The lower edge finish 10 comprises a channel 12 formed from a first sidewall 14 and a second sidewall 16. The first sidewall 14 and second sidewall 16 are spaced a distance apart to accommodate a bottom edge of a drywall sheet within the channel 12. Preferably, the channel 12 permits a snug fit of the bottom edge of the drywall sheet. The lower edge finish 10 includes a base 20 below the channel 12 for supporting a drywall sheet inserted within the channel.

Sidewalls 14 and 16 span a length of the channel 12, either the entire length of the channel or a substantial portion of it. Similarly, the base 20 spans at least a portion of the length of the channel. One or more bases 20 may be included underneath the channel 12 for support. Preferably, the base 20 extends along a substantial portion of the channel 12 to provide a stable platform for a drywall sheet installed within the channel 12.

The first sidewall 14 is preferably at a height to help retain a lower edge of a drywall sheet within the channel 12 at a substantially upright position as the upper parts of the drywall sheet are secured to the stud wall in conventional fashion. The lower edge of the drywall sheet may need no additional nails or screws to mount to the stud wall, since it is held in place by the lower edge finish 10. The second sidewall 16 is preferably at a height so that it may be fastened onto a stud wall. In the embodiment shown, the second sidewall 16 has a height greater than the first sidewall 14. The base 20 has a height of about ½ inches or higher to prevent a drywall sheet in the channel 12 from coming into contact with a floor surface.

Figure 2:
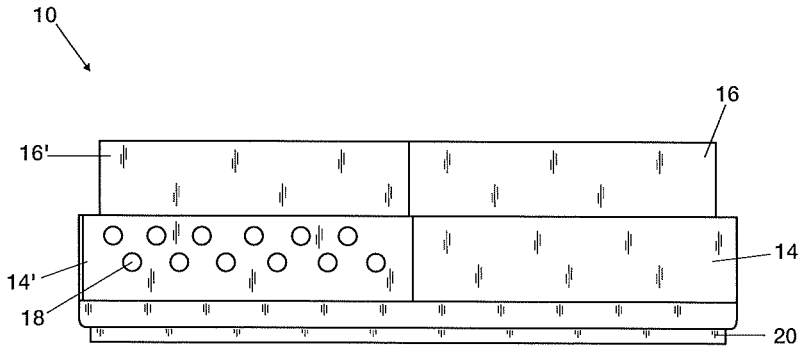
FIG. 2 is a front perspective view of two embodiments of a lower edge finish.

FIG. 2 depicts two examples of a lower edge finish 10. In both examples, the base 20 is comprised of an extruded plastic. On the left side, the sidewalls 14' and 16' are each comprised of sheet metal. On the right side is an example wherein the sidewalls 14 and 16 are comprised of an extruded plastic.

In the sheet metal embodiment shown in FIG. 2, the first sidewall 14' may be perforated so that drywall mud, when smeared onto the first sidewall, will be able to ooze into the holes and attach itself to the face of a drywall sheet. This creates a more solid bond of the mud between the face of a drywall sheet and the face of the first sidewall 14'. If the first sidewall 14' does not include perforations, the mud may only able to bond to the first sidewall, which may cause cracking of the mud at the top edge of the first sidewall 14' over time.

Figure 3:
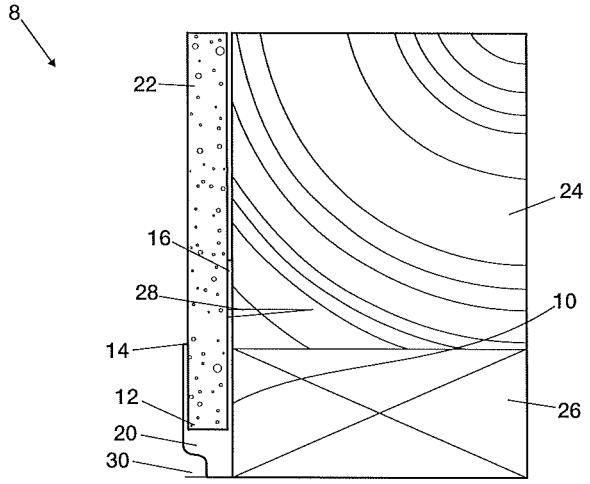
FIG. 3 is a side sectional view of a wall assembly mounted to a stud wall and with a drywall sheet in place with a lower edge finish constructed according to one embodiment.

One example of a wall assembly 8 that includes a lower edge finish 10 is shown in FIG. 3. Studs 24 of a stud wall are installed onto a plate 26 to provide a structural frame for supporting a wall. FIG. 3 shows the studs and plate made of wood, but metal can also be used. The lower edge finish 10 is placed on the floor surface 30 adjacent to the stud wall and plate 26, and positioned such that the second sidewall is surface mounted on the studs and plate of the stud wall. The lower edge finish 10 is secured onto a stud 24 via a fastener 28 such as a nail or screw that passes through a hole (preformed or formed by the fastener) in the second sidewall 16. A drywall sheet 22 is inserted into the channel 12, wherein the exposed face of the drywall sheet 22 is adjacent to the first sidewall 14 and the other face of the drywall sheet is adjacent to the second sidewall 16 and stud wall 24.

The base 20 does not extend under or into the studs 24. Instead, the base 20 and second sidewall 16 are surface mounted on the studs 24 and plate 26. While the example provided shows the base 20 substantially flush with both the first sidewall 14 and the second sidewall 16, other examples of the base 20 may extend away from the plate 26 past the first sidewall 14. The base 20 acts as a raised support for the drywall sheet 22 without leaving a gap under the assembly below the floor, obviating the need of a baseboard.

Figure 4:
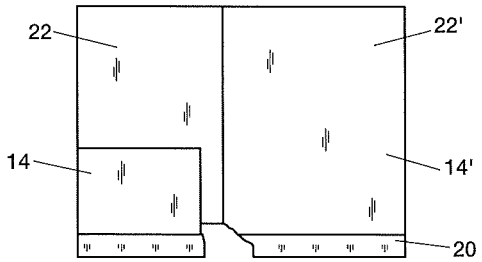
FIG. 4 is a front elevational view of a wall assembly with a lower edge finish.

The invention may also be considered a method for installing drywall. In one embodiment, the method comprises installing a stud wall including studs 24 and a plate 26, fastening a channel 12 formed from a first sidewall 14 and a second sidewall 16 to the stud wall, and inserting a drywall sheet 22 within the channel 12. The second sidewall 16 may be positioned to abut the stud wall and be fastened to it. The method may further include the step of applying mud and painting the drywall sheet 22' and first sidewall 14 to create a uniform appearance, as seen in the right side of FIG. 4. An unpainted drywall sheet 22 and first sidewall 14' are shown on the left side of FIG. 4 for comparison.

The lower edge finish 10 can be made in various lengths, such as 8, 20 or 12 feet in length, or suitable metric lengths. Lengths that are on the order of the length of standard drywall sheets may be used, or other lengths can be used. If a piece of the lower edge finish 10 is too long for a stud wall on which mounting is desired, the piece can be cut to size.

Certain modifications and improvements will occur to those skilled in the art upon reading the foregoing description. By way of example, the sidewalls may be comprised of a rigid type of extruded paper. It should be understood that all such modifications and improvements have been omitted for the sake of conciseness and readability, but are properly within the scope of the following claims.

What is claimed is:

1. A lower edge finish for a dry wall comprising:

a channel formed from a first sidewall and a second sidewall for receiving a drywall sheet, and a base underneath the channel for supporting the drywall sheet above a surface, the base having a front face under the first sidewall that recesses toward the second sidewall by a distance greater than the first sidewall's thickness, the base of the first sidewall is at substantially the same plane as the first sidewall and is free of protrusions from that plane in a direction away from the second sidewall, and wherein the second sidewall and the base are adapted to be surface mounted on a stud wall and the lower edge finish is free of extension toward the stud wall.

2. The lower edge finish of claim 1, wherein the base does not extend toward the stud wall past the second sidewall.

3. The lower edge finish of claim 2, wherein the base is flush with the first sidewall and second sidewall.

4. The lower edge finish of claim 1, wherein the second sidewall is taller than the first sidewall.

5. The lower edge finish of claim 1, wherein the first sidewall is adapted to be substantially flush to a drywall sheet that may be inserted into the channel.

6. The lower edge finish of claim 1, wherein the base is continuous along a length of the channel.

7. The lower edge finish of claim 1, wherein the base has a height of about ½ inches.

8. The lower edge finish of claim 1, wherein the base is comprised of extruded plastic.

9. The lower edge finish of claim 8, wherein the first sidewall and the second sidewall are comprised of sheet metal.

10. The lower edge finish of claim 9, wherein the first sidewall is perforated.

11. A wall assembly comprising:

a stud wall forming a support frame, a lower edge finish installed on the bottom of the stud wall, the lower edge finish comprising i) a channel formed from a first sidewall and a second sidewall for receiving a drywall sheet, and ii) a base underneath the channel for supporting the drywall sheet above a surface, the base having a front face under the first sidewall that recesses toward the second sidewall by a distance greater than the first sidewall's thickness, the base of the first sidewall is at substantially the same plane as the first sidewall and is free of protrusions from that plane in a direction away from the second sidewall, and a drywall sheet having a lower edge in the channel with its weight supported by the base secured to the stud wall, wherein the second sidewall and the base are surface mounted on the stud wall.

12. The wall assembly of claim 11, wherein the stud wall includes a plate on the bottom of studs.

13. The wall assembly of claim 12, wherein the base does not extend toward the stud wall past the second sidewall.

14. A method for installing drywall comprising:

installing a stud wall onto a floor, followed by fastening a channel formed from a first sidewall and a second sidewall to the stud wall at the floor the channel having abase that has a front face under the first sidewall that recesses toward the second sidewall by a distance greater than the first sidewall's thickness, the base of the first sidewall is at substantially the same plane as the first sidewall and is free of protrusions from that plane in a direction away from the second sidewall, and inserting a drywall sheet within the channel.

15. The method of claim 14, wherein the step of installing a stud wall comprises assembling studs onto a plate.

16. The method of claim 14, wherein the step of fastening the channel to the stud wall comprises positioning the second sidewall to abut the stud wall and fastening the second sidewall to the stud wall.

17. The method of claim 16 further including applying mud to a top edge of the first sidewall and painting the drywall sheet and first sidewall to create a uniform appearance.

* * * * *